US007014039B2

(12) United States Patent
Henson et al.

(10) Patent No.: US 7,014,039 B2
(45) Date of Patent: Mar. 21, 2006

(54) SLIDING SHELL PACKAGE FOR SMOKING ARTICLES

(75) Inventors: Jane Cottrell Henson, Clemmons, NC (US); Veronica Nicole Walton, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 52 days.

(21) Appl. No.: 10/465,460

(22) Filed: Jun. 19, 2003

(65) Prior Publication Data

US 2004/0256253 A1 Dec. 23, 2004

(51) Int. Cl.
*B65D 85/10* (2006.01)

(52) U.S. Cl. ..... 206/267; 206/236; 206/265; 206/259; 206/774; 206/779

(58) Field of Classification Search ..... 206/528–540, 206/807; 220/345.2, 345.3, 345.4, 351, 345.1, 220/656, 658, 659, 265, 267, 236, 259, 774, 220/779

See application file for complete search history.

(56) References Cited

U.S. PATENT DOCUMENTS

| | | | | |
|---|---|---|---|---|
| 926,537 | A | 6/1909 | Bagley | |
| 927,638 | A | 7/1909 | Chambers | |
| 941,140 | A | 11/1909 | Glover | |
| 970,258 | A | 9/1910 | Nock | |
| 1,341,295 | A | 5/1920 | Burtis | |
| 1,581,547 | A | 4/1926 | Rowe | |
| 1,582,991 | A * | 5/1926 | Lloyd | 206/267 |
| 1,685,765 | A | 9/1928 | Mangan | |
| 1,797,419 | A | 3/1931 | Hothersall | |
| 1,860,637 | A | 5/1932 | Von Meister | |
| 1,946,845 | A | 2/1934 | Fisher | |
| 1,958,101 | A * | 5/1934 | Duell | 221/246 |
| 2,012,033 | A | 8/1935 | Atwater et al. | |
| 2,295,747 | A * | 9/1942 | Mills | 220/351 |
| 2,313,428 | A | 3/1943 | Glenn | |
| 2,315,900 | A | 4/1943 | Lupfer | |
| 2,378,003 | A * | 6/1945 | Duell | 221/93 |
| 2,378,774 | A | 6/1945 | Husted | |

(Continued)

FOREIGN PATENT DOCUMENTS

GB 2 212 471 7/1989

(Continued)

OTHER PUBLICATIONS

Congdon-Martin, Douglas, "Tobacco Tins: A Collector's Guide," 1992.

*Primary Examiner*—Mickey Yu
*Assistant Examiner*—Jerrold Johnson
(74) *Attorney, Agent, or Firm*—Brinks Hofer Gilson & Lione

(57) ABSTRACT

Smoking articles, such as filter cigarettes, are packaged in a metal box which is curved to a shape that conforms to the curvature of the human body so that the box can be comfortably carried in a shirt or pant pocket. The metal box comprises a lid and a four sided tray. The lid and the tray have rolled lips which interengage to mechanically and slidably retain the lid to the tray. The lid covers the open front of the tray and is slidable along an arcuate path corresponding to the radius of curvature of the lid to selectively open or close the front of the tray. The lid of the box includes an abutment that prevents the lid of the box from being completely removed unless additional force is applied to push the abutment past the rear wall of the tray.

24 Claims, 5 Drawing Sheets

U.S. PATENT DOCUMENTS 2,472,582 A 6/1949 Green
2,489,452 A 11/1949 Davis
2,531,737 A * 11/1950 Lyon, Jr. ..... 220/345.3
2,582,821 A * 1/1952 Duell et al. ..... 221/246
2,867,369 A 1/1959 Cemera
3,168,952 A 2/1965 Palmer
3,298,504 A 1/1967 Carter
3,334,734 A 8/1967 Meyers
3,670,881 A 6/1972 Dutcher
3,765,529 A 10/1973 Mueller
3,782,584 A * 1/1974 Swenson et al. ..... 220/345.3
3,896,928 A * 7/1975 Forte ..... 206/779
3,927,820 A 12/1975 Wagner et al.
4,300,675 A 11/1981 Wagner
4,342,403 A 8/1982 Badtke et al.
4,465,184 A 8/1984 Bruce
4,718,553 A 1/1988 Adamoli et al.
5,131,536 A 7/1992 Wu
5,201,463 A 4/1993 George
5,375,698 A * 12/1994 Ewart et al. ..... 206/5.1
5,458,256 A 10/1995 Opheim
5,507,429 A 4/1996 Arlin
D370,081 S 5/1996 Mauldin
5,544,770 A * 8/1996 Travisano ..... 215/230
5,590,779 A 1/1997 Ramsey
5,682,986 A 11/1997 Cobler
6,216,861 B1 4/2001 James et al.
6,363,691 B1 4/2002 Flaherty
6,435,342 B1 8/2002 Agnes
6,672,471 B1 * 1/2004 Cross ..... 220/345.4
6,736,261 B1 * 5/2004 Thomas et al. ..... 206/265
D507,968 S * 8/2005 Dixon et al. ..... D9/422
2004/0217116 A1 * 11/2004 Offerman et al. ..... 220/345.2

FOREIGN PATENT DOCUMENTS

WO WO 03/002427 1/2003

* cited by examiner

SLIDING SHELL PACKAGE FOR SMOKING ARTICLES

FIELD OF THE INVENTION

The present invention relates to packages for smoking articles, such as filter cigarettes, and a method for packaging and unpackaging smoking articles, such as filter cigarettes, and more particularly to a unique and aesthetically pleasing, tamperproof sliding shell package for cigarettes, which can be only partially opened to dispense the articles, further packaged in a paperboard box overwrapped with a polymeric film having a tear tape.

BACKGROUND

It has been known for many years to package cigarettes and other types of tobacco or smoking article products in thin sheet metal packages or boxes of a size suitable for carrying in a shirt or coat pocket. Such packages have been known as "tobacco tins" or "pocket tins" or "tobacco cans." Typically, such cans or tins have a hinged top lid which is pivoted open to allow access to the can contents, or a sliding top lid which is slid along guides to one side or the other to allow access to the can contents, or a pressed-on top lid that is urged upwardly to remove it from the top of the can. A few examples of such known tobacco cans are disclosed in U.S. Pat. Nos. 1,341,295; 1,797,419; and 1,946,845. It is known that such metal cans or tins are better able to preserve the freshness of cigarettes and other tobacco products contained therein.

In recent years, manufacturers of cigarettes and other tobacco products have packaged cigarettes in paper and paperboard wrappers and boxes and have used foil/paper laminates, metallized paper or plastic wrappers or low permeability transparent or metallized polymeric sheet overwraps, among other types of packaging, to preserve the freshness and aroma of the packaged cigarette and tobacco products. Examples of such packages are disclosed in U.S. Pat. Nos. 4,852,734; 5,139,140; and 5,542,529 assigned to the assignee of the present invention.

Such packaging has become commonplace for most cigarette manufacturers so that, apart from strong brand names and trademarks, product packaging itself has not provided the sort of product differentiation in the marketplace for cigarettes that it has for other consumer products, many of which utilize unique forms of packaging for product differentiation or product origin purposes. It would be desirable, therefore, to provide a cigarette package and a packaging method that would improve product differentiation of cigarettes in the marketplace and still achieve appropriate preservation of the freshness and aroma of the cigarettes.

While it is desirable to have a sliding front lid, it is also useful for the consumer to have a mechanism that prevents such a lid from being completely removed from the tin. Such mechanisms have been complicated and costly to manufacture, in comparison to the overall manufacturing costs of the tin. Furthermore, such mechanisms still allow the tin to be completely open, making the contents of the tin susceptible to spilling during use of the device. Therefore, it is desirable to have a sliding shell tin with a mechanism that will allow the lid of the tin to slide only partially across the body of the tin, allowing the user to access only the contents of the tin which are desired for use.

BRIEF SUMMARY

The present invention is directed to a novel package article comprising a curved metal box or tray with a metal lid slidable along an arcuate path for containing a plurality of smoking articles, such as 20 filter cigarettes, in a tamperproof and freshness-preserving manner, as well as a method of packaging and unpackaging the smoking articles. Conventionally, a filter cigarette package is in the form of a rectangular parallelepiped having six sides or panels, wherein the "top" of the package is that package side or panel toward which all of the filters of the filter cigarettes are oriented, and the "bottom" of the package is the side or panel opposite the "top." The "front" and "back" of the typical conventional cigarette package are the two sides or panels of the greatest surface area, and the remaining two opposite sides or panels extend between and connect the front and back and the top and bottom. The package of the present invention will be described generally using the foregoing terms, namely, top and bottom, front and back and opposite sides or panels.

Although the package of the invention may be configured in a number of forms that are not specifically illustrated herein, a preferred embodiment of the invention comprises a five-sided metal box or tray with an open front and a metal front lid that comprises a sixth side or panel of the tray with guides or tracks along two edges. The top, bottom and opposite sides of the box are approximately perpendicularly upstanding from the back of the box. The guides or tracks of the front lid are slidable along complementary guides or tracks on two edges of the metal tray to thereby open and close the open front of the metal tray. The back of the metal tray and the front of the metal lid each have a curved or arcuate shape generally in the form of a segment of a cylinder, the radius of curvature of the back of the metal tray being somewhat smaller than the radius of curvature of the front of the metal lid. Thus, when the metal lid is slid along the complementary guides relative to the metal tray, it moves along an arcuate path with a radius corresponding substantially to the radius of curvature of the metal lid.

The metal tray and lid are preferably formed of a thin metal, such as 1018 steel alloy or 3003 aluminum alloy, having an as-formed thickness of between about 0.005 to about 0.015 inches. The tray and lid have rounded corners and are preferably shallow drawn cans, but may be formed by other conventional metal working processes. The upper edges of the four upstanding sides of the tray are rolled over to form a smooth rolled lip around the entire periphery of the upper edge of the tray. This rolled lip advantageously eliminates any exposed sharp metal edges that might otherwise cut the consumer and also provides a track for slidably engaging a complementary rolled edge on three edges of the metal lid in substantial metal-to-metal contact. One edge of the lid and short portions of the adjacent lid edges are folded over and flattened to eliminate exposed sharp edges on the lid that could cut the consumer. The flattened portions of the lid preferably contact the rolled lip of the tray so that the lid engages the rolled lip in substantial metal-to-metal engagement around the entire periphery of the open front of the tray. The metal lid and/or metal tray may be embossed, stamped, or printed, for decorative purposes or for providing additional stiffness to the metal tray or lid.

After the metal tray is filled with smoking articles, cigarettes, for example, and the lid is slid over the open front of the tray to close the same, a shrinkable band, preferably a heat-shrinkable polymeric band, is positioned around the engaged edges of the lid and tray and is shrunk, e.g., by application of heat, to urge the edges of the lid and the rolled lip of the tray in substantial sealing contact so as to aid in preserving the freshness and aroma of the cigarettes contained in the tray. The shrinkable band is preferably provided with one or more rows of transverse perforations or a tear strip for assisting in the removal of the band when it is desired to open the box.

The sealed metal cigarette box may be marketed as the final cigarette package, however, according to another aspect of the invention, the sealed metal cigarette box may be, and is preferably, further packaged in a paperboard box or label wrap overwrapped with a polymeric film, such as a transparent polypropylene film or a metallized polyethylene terephthalate film, and is provided with a tear tape for tearing off the overwrap film covering the paperboard box or label wrap. The paperboard box is preferably in the form of a rectangular parallelepiped with the front panel or lid thereof hinged at one side by a fold or crease line in the paperboard box. To enhance the attractiveness of the package when a transparent overwrap film is used, a portion of the lid of the paperboard box may be cut away to expose a portion of the curved metal box, preferably a portion of the metal lid of the box having a design or indicia embossed or printed therein.

If the overwrap is a transparent polymeric film, the paperboard box is preferably printed with product indicia, logos and the like. If the overwrap is a metallized polymeric film, such as, for example, the overwrap film described in U.S. Pat. No. 5,427,235, assigned to the assignee of the present invention, the printed product indicia, logos, etc., are preferably printed on the overwrap film and may or may not be duplicated on the paperboard box.

According to the method of the invention, a package comprising a curved metal tray containing a plurality of cigarettes is closed by a curved metal lid which is mechanically and slidably engaged to the metal tray. The metal lid is sealed in substantial metal-to-metal contact to the metal tray with a perforated shrinkable band, and then the sealed metal box is packaged in a paperboard box overwrapped with a polymeric film having a tear tape. To open or unpackage the cigarettes in the metal box, the tear tape is used to tear the polymeric film away so that the metal box can be removed from the paperboard box. The shrinkable band is then ruptured along the perforations in the band and removed and the metal lid is slid along an arcuate path to open the front of the metal box and expose the cigarettes contained therein.

Another embodiment of the present invention includes a curved metal package, as described above, which includes two abutments. The first abutment extends sufficiently below the back surface of the lid to contact the side wall of the tray when the lid is in a closed position. The second abutment extends sufficiently below the back surface of the lid to contact the side wall when the lid is in an open position and restrains further sliding of the lid in an opening direction. Desirably, the second abutment is a depression, formed in the front surface of the lid.

Preferably, the first and second abutments are disposed a distance apart from one another to provide an opening to expose the contents of the tray where the opening is between about one-fourth and one-half of the length of the tray in the direction of the sliding movement of the lid.

With the foregoing and other advantages and features of the invention that will become hereinafter apparent, the nature of the invention may be more clearly understood by reference to the following detailed description of the invention, the appended claims and the views illustrated in the drawings.

DETAILED DESCRIPTION OF THE PRESENTLY PREFERRED EMBODIMENTS

Figure 1:
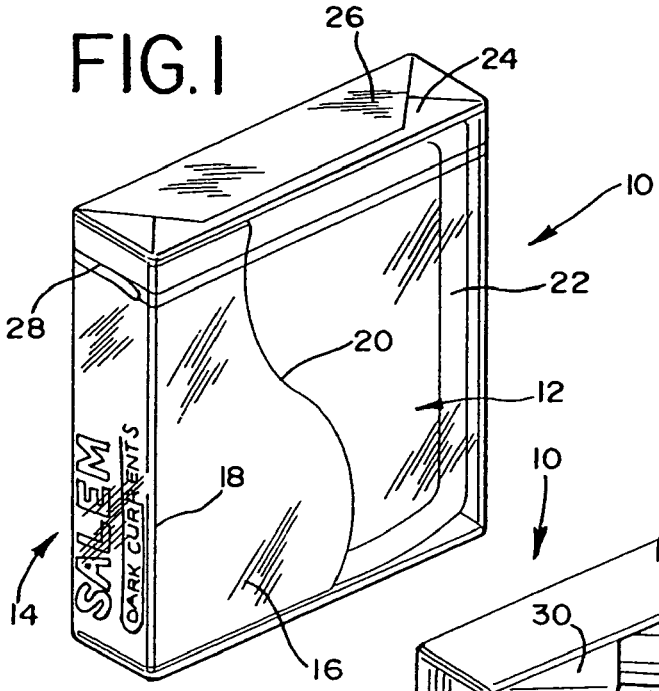
FIG. 1 is a perspective view of one embodiment of a cigarette box package made according to the invention with a sealed metal cigarette box enclosed in a paperboard box and overwrapped with a polymeric film.

Referring now in detail to the drawings, preferred embodiments of the invention shown in FIGS. 1–14 comprise a smoking article or filter cigarette package designated generally by reference numeral 10. In the embodiment shown in FIG. 1, package 10 has a rectangular parallelepiped shape and contains a metal cigarette box 12 described in more detail hereinafter. Package 10 comprises a paperboard box 14 folded from a paperboard blank (not shown) into a parallelepiped shape. The box 14 is provided with a front panel or lid 16 hinged along folded corner 18 of the box 14. Front panel 16 only partially covers the front opening of the box so as to leave exposed a portion of the metal cigarette box 12.

The free edge 20 of the lid 16 is generally S-shaped as shown, it being understood that edge 20 may have other shapes, both linear and non-linear. For instance, the edge 20 may be a straight linear edge oriented at an angle with respect to hinged corner 18, it may have a V-shape, or it may have an rounded, generally D-shape. Preferably, however, the shape of the edge 20 provides the paperboard box with a product differentiation or recognition feature. For example, the illustrated S-shaped edge of the paperboard box makes the package 10 of the invention especially suited for packaging the Salem® brand of menthol cigarettes manufactured by the assignee of the present invention. Other shapes of the front panel 16 that provide product differentiation or recognition features will be apparent to those skilled in the art.

The front panel 16 of the box 14 is also typically provided with printed product information or indicia, such as a logo or other trademark, and the other panels of the box 14 may also have printed indicia thereon, such as product information.

The box 14 is overwrapped with an overwrap film 22 which is preferably a transparent polymeric film, such as polypropylene, but which may be a metallized polymeric film. The film 22 is folded over at the top and bottom (not shown) of the package 10 and the flaps 24, 26 are heat sealed in a conventional manner. If the film 22 is a metallized polymeric film, the printed indicia on the paperboard box 14 is preferably printed on the film 22 instead of, or in addition to, being printed on the panels of the box. A tear tape 28 is provided on the overwrap film 22 for use in removing the overwrap film from the paperboard, thereby permitting it to be opened by the consumer.

Figure 2:
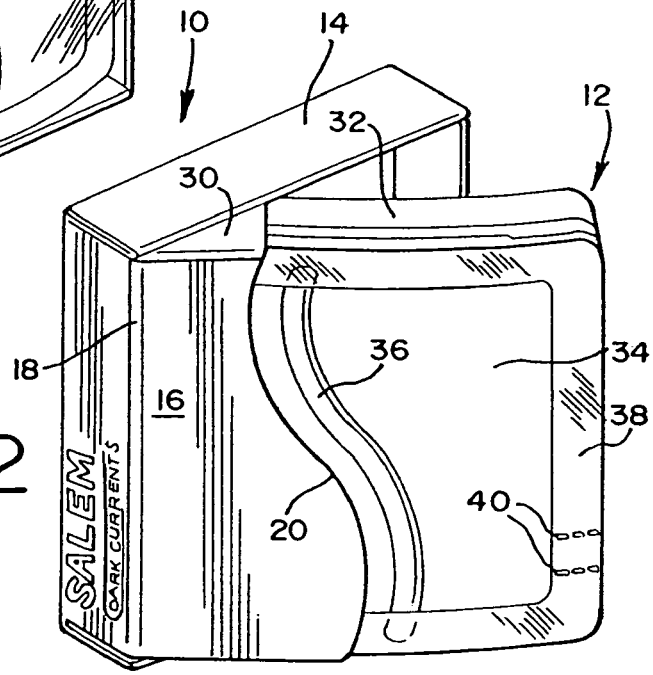
FIG. 2 is a perspective view of the package of FIG. 1 showing the overwrap removed and the hinged partial lid of the paperboard box open for removal of the metal cigarette box sealed with a shrinkable band.

FIG. 2 illustrates the package 10 with the overwrap 22 and tear tape 28 removed and the front panel 16 swung away from the box 14 to permit the metal cigarette box 12 to be removed from the paperboard box 14. As shown in FIG. 2, the front panel 16 is provided with side tabs 30 (only one shown) folded inwardly so as to slide along the inside of the top and bottom panels of the box 14 and provide additional support for the panel 16.

Figure 13:
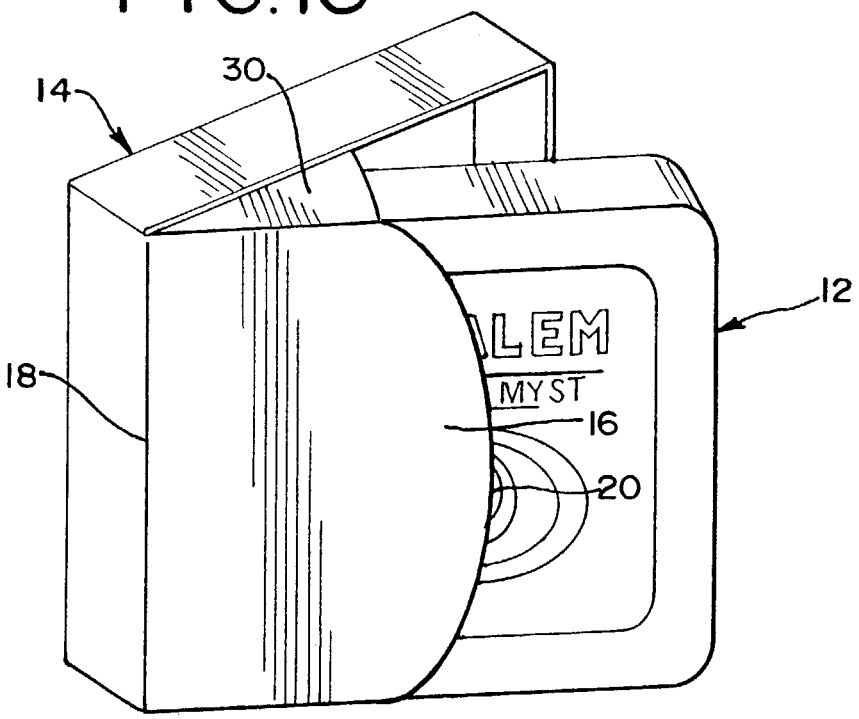
FIG. 13 is a front-side perspective view of another embodiment of the metal box and paperboard box of the present invention.
Figure 14:
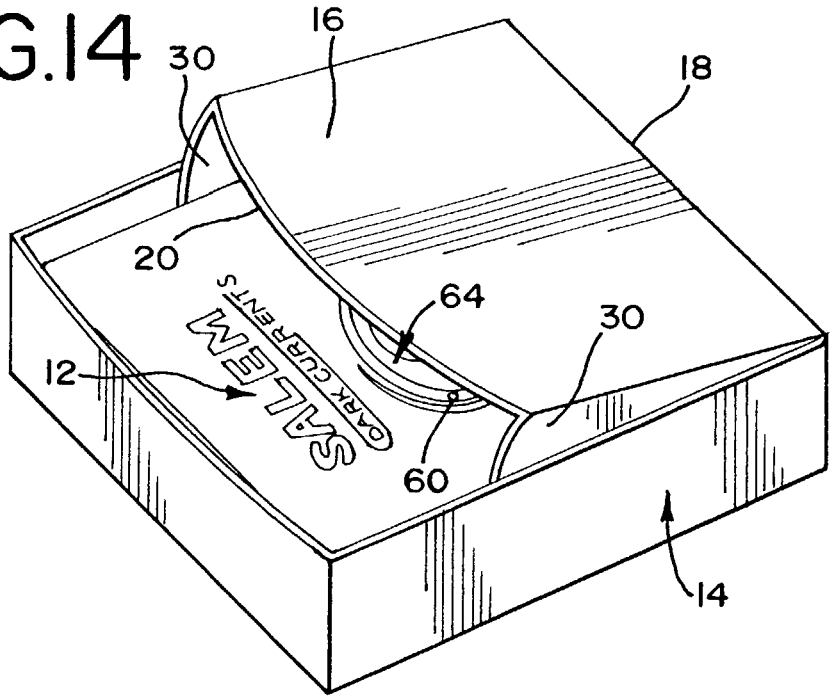
FIG. 14 is a top perspective view of yet still another embodiment of the metal box and paperboard box of the present invention.

FIGS. 13 and 14 illustrate another embodiment of the paperboard box 14, as shown encasing the metal cigarette box 12, with the overwrap 22 and the tear tape 28 removed and the front panel 16 swung away from the box 14. This embodiment illustrates another possible shape of the free edge 20 of the front panel 16. The free edge may be generally D-shaped to compliment the product indicia printed or embossed on the metal cigarette box 12 therein.

The metal cigarette box 12 comprises a five-sided metal tray portion 32 and a slidable metal lid portion 34 covering the front open side of the tray portion 12. The top, bottom, and opposite sides of the metal cigarette box 12 are approximately perpendicularly upstanding from the back of the metal box 12. (FIGS. 3–11). The lid portion 34 is preferably embossed or stamped for purposes of stiffness and/or product differentiation or product origin information. In the illustrated embodiment, the lid 34 is embossed with a generally S-shaped ridge or bead 36 that corresponds to the S-shaped edge 20 of the paperboard front panel 16 so as to provide product differentiation or product origin information even after the paperboard box is removed and discarded. Other portions of the lid 34 may also be embossed, stamped, or printed, if desired.

Figure 12:
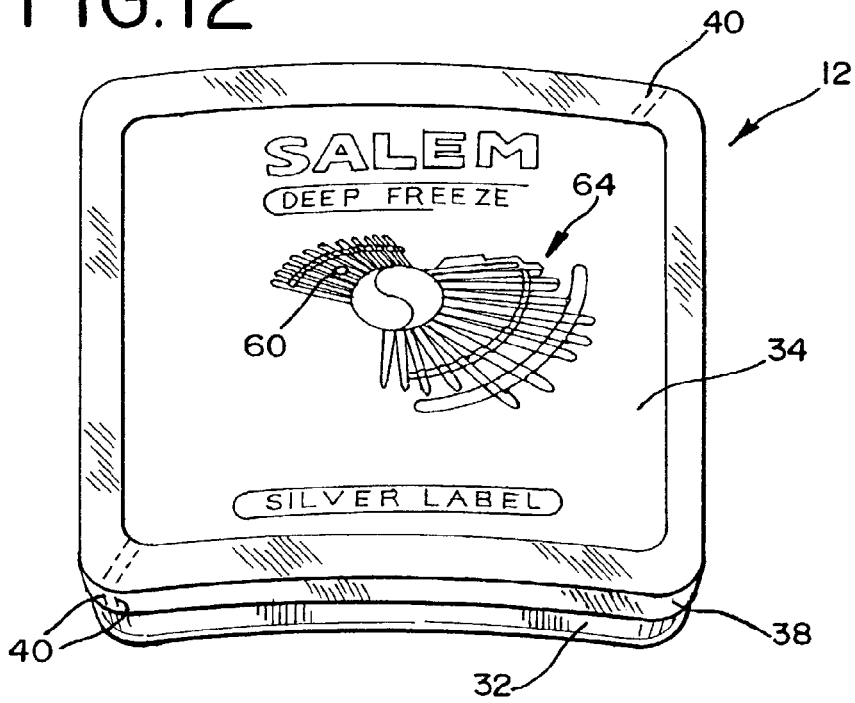
FIG. 12 is a top-front perspective view of still another embodiment of the metal box of the present invention including a shrink wrapped band around the periphery of the box.

A band 38 of shrinkable polymeric material, preferably a heat-shrinkable polymer, is shrunk about the perimeter of the metal cigarette box 12 to seal the lid 34 to the tray 32 in a tamperproof manner (See FIGS. 2 and 12). Perforations 40 are provided transversely of the band so as to permit the band to be torn away from the box 12 and allow the consumer to access to the cigarettes contained in the box.

Figure 10:
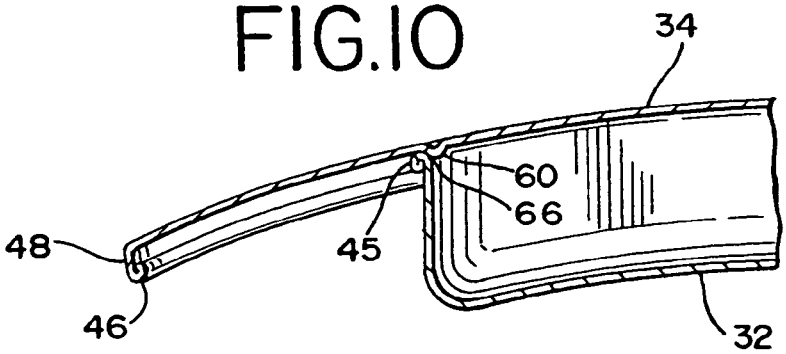
FIG. 10 is a cross-sectional view of the cigarette box of FIG. 8 taken along line 10—10.
Figure 11:
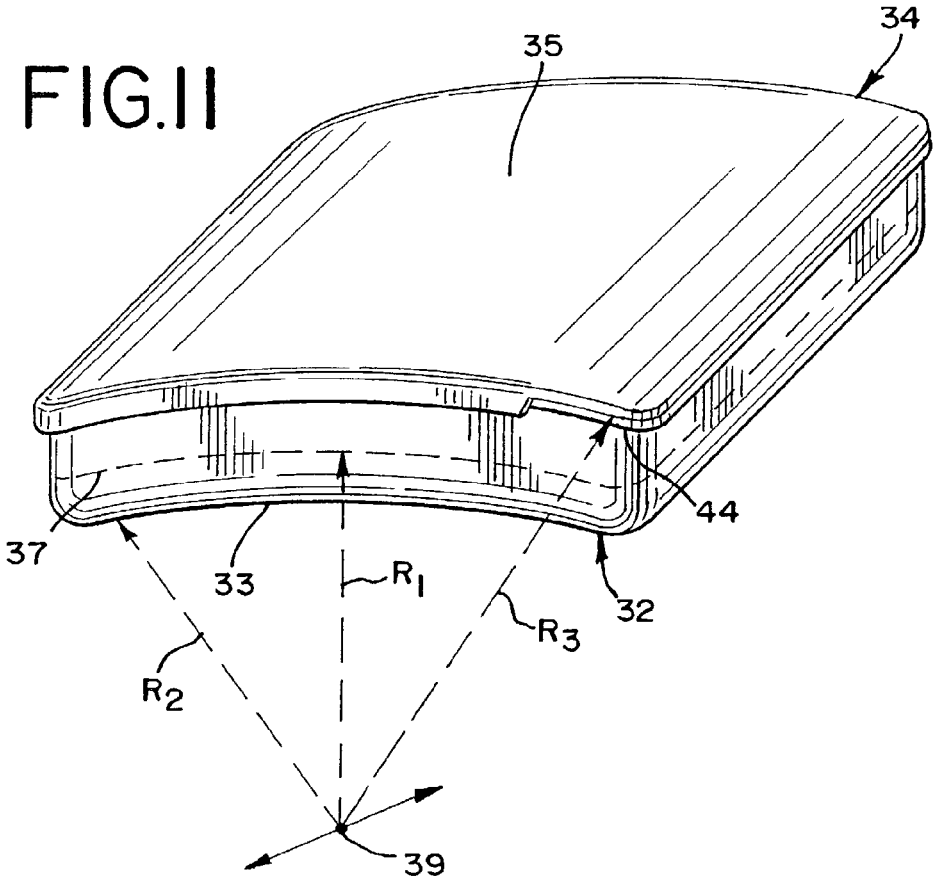
FIG. 11 is side perspective view of yet another embodiment of the metal box showing the different radii of curvature for the various components of the box.

Referring now to FIGS. 3–11, the metal cigarette box 12 of the present invention will be described. As shown in FIGS. 3, 4, 8, and 11, the tray 32 and lid 34 have a curved and rounded shape. Referring specifically to FIG. 11, the tray 32 and the lid 34 each have an opposing major surface, 33 and 35 respectively, with a radius of curvature R2 and R3 between 100 mm and 800 mm. The tray and the lid are positioned with respect to each other such that a hypothetical surface 37 midpoint P between major surfaces 33 and 35 also has a radius of curvature R1 between 100 mm and 800 mm. Preferably the radius of curvature R1 is about 200 mm. Preferably, the radii of curvature R2 and R3 of the opposing major surfaces 33 and 35 are selected and the surfaces positioned so that they are concentric about a common axis 39 when the cigarette box 12 is in a closed position. Preferably, the radius of curvature of the major opposing surface 33 of the tray 32 will generally be smaller than that of the major surface 35 of the lid 34. The designed curvature corresponds generally to the curvature of the torso of the human body so that the box will fit comfortably in, and generally conform to, the body when the box is placed, for example, in a shirt or pant pocket. The rounded corners and edges of the box are also designed to provide a more comfortable "feel" for the consumer as well as an attractive package.

Figure 3:
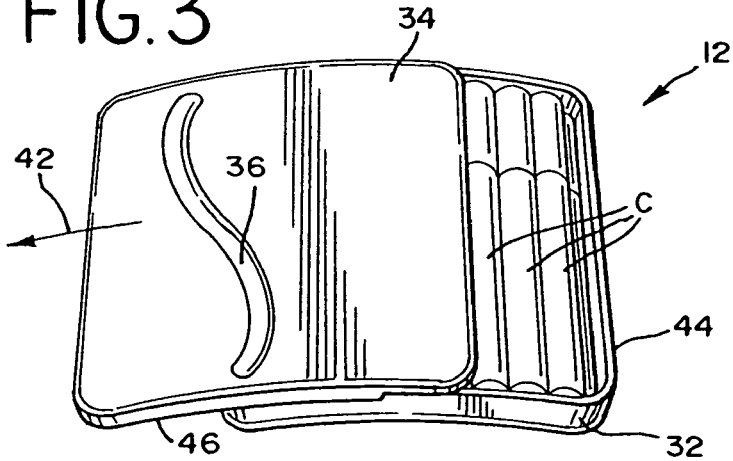
FIG. 3 is a perspective view of the metal cigarette box of FIG. 2 showing the shrinkable band removed from the metal box and the slidable lid of the metal box opened to expose the cigarettes contained therein.
Figure 8:
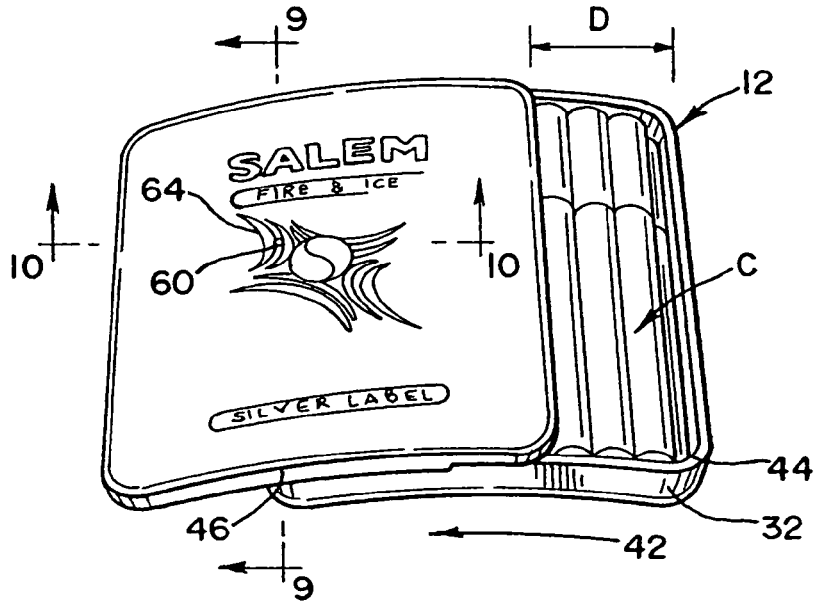
FIG. 8 is a perspective view of another embodiment of a cigarette box package filled with cigarettes and made according to the invention.
Figure 9:
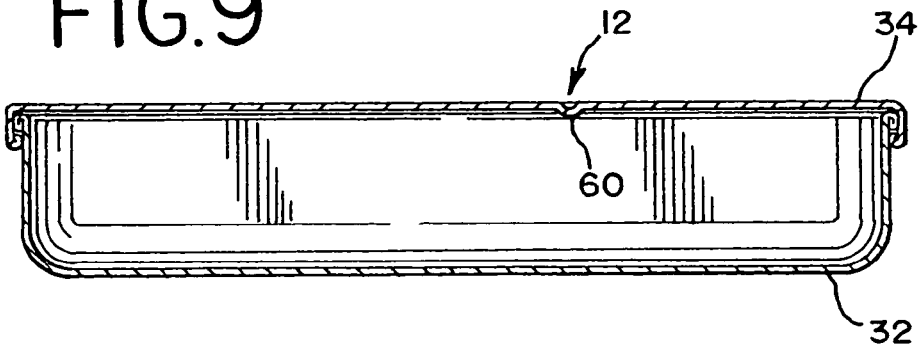
FIG. 9 is a cross-sectional view of the cigarette box of FIG. 8 taken along line 9—9 showing the indentation of the lid protruding into the open front of the body.

The lid 34 is slidable in one direction, i.e., to the left as shown by the arrow 42 in FIGS. 3 and 8, to open the box 12 and permit consumer access to the cigarettes C in the tray portion 32. The lid 34 may also include an abutment 60 that protrudes from the underside of the lid 34 into the open front of the tray (See FIG. 9). This abutment 60 will prevent the lid 34 of the metal box 12 from being completely removed from the tray 32, unless additional force is applied to push the abutment past the side wall 45 of the tray 32. As shown in FIG. 10, the abutment 60 on the lid may be an indentation in the metal lid 34. The abutment may be added separately to the lid or it is, desirably, formed integrally with the lid. The indentation may have a diameter of about 1 mm to about 5 mm and a height of about 0.1 mm to about 2 mm, but desirably the indentation will have a diameter of approximately 1.5 mm and a height of approximately 0.65 mm.

The abutment 60 of the lid 34 is positioned to allow the lid 34 to be opened a distance D. Preferably, dimension D is less than half the width of the tray. More preferably, dimension D is approximately equal to the diameter of two cigarettes. The abutment 60 is preferably hidden in product differentiation indicia 64 that are placed on the outer surface of the lid 34. (See FIGS. 8, 12, and 14). Desirably, the lid 34 of the box 12 will be flexible enough that the user, upon applying added force, may push the abutment 60 of the lid 34 past the side wall 45 of the tray 32 to open the box 12 completely.

To facilitate full opening of the lid, the abutment 60 preferably does not protrude greatly below the upper edge of the side wall 45 and the abutment 60 has a sloped leading edge. Preferably, as shown in FIG. 10, the abutment 60 has a depth of 1.5 mm and a leading edge corner 66 with a radius of curvature of about 0.375 mm, which allows the front of the lid 34 deflect upwards so the abutment may slide over the upper edge of the side wall 45 upon application of sufficient lateral force to the lid.

Figure 4:
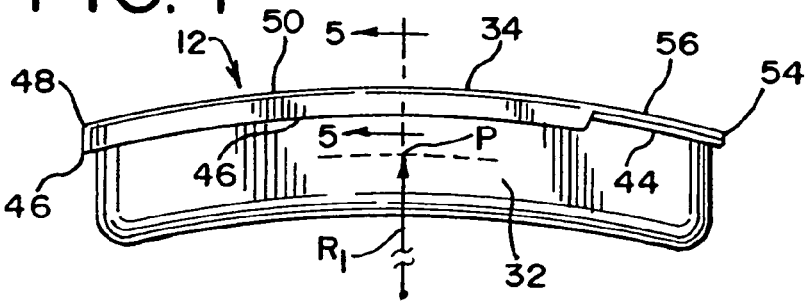
FIG. 4 is a side elevation view of the metal cigarette box of FIG. 3.
Figure 6:
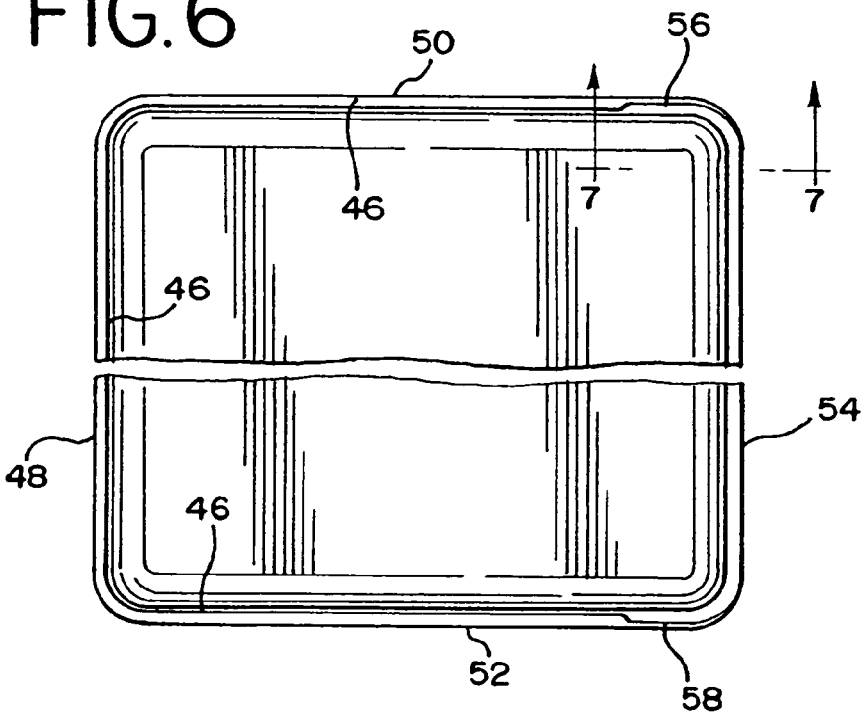
FIG. 6 is a plan view of the metal lid for the metal cigarette box of FIG. 4 as viewed from the underside or from the inside of the box.
Figure 5:
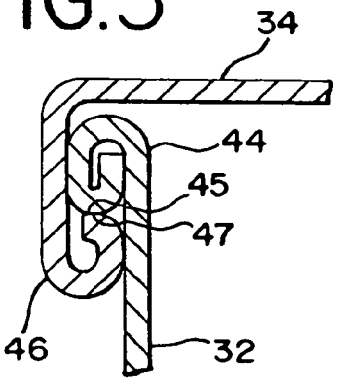
FIG. 5 is a cross-sectional detailed view taken along line 5—5 of FIG. 4 showing the structure of the mechanical sliding engagement between the rolled edges of the metal lid and the metal box of the invention.
Figure 7:
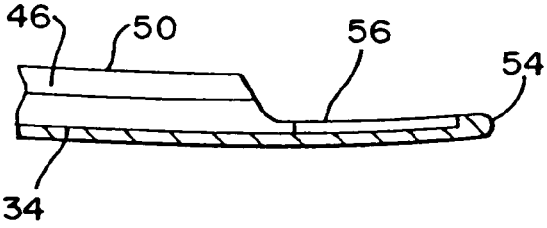
FIG. 7 is a cross-sectional detailed view taken along line 7—7 of FIG. 6 showing the transition between the flattened edge of the metal lid and the rolled edge of the metal lid.

After a cigarette C is removed from the tray portion 32, the lid 34 is slid in the direction opposite the arrow 42 to reclose the box 12. The lid 34 is mechanically and slidably retained on the tray portion 32 by interengaging rolled edges, flanges, or lips 44 and 46 on the tray portion 32 and the lid portion 34, respectively (FIG. 5). Specifically, as shown in FIG. 5, a front surface 47 of the rolled lid lip 46 is in sliding engagement with a back surface 45 of the rolled tray lip 44. The rolled lip 44 of the tray portion 32 is formed around the entire perimeter of the tray portion 32, whereas the rolled lip 46 of the lid portion 34 is formed along the entire edge 48 and a substantial portion of the edges 50, 52 of the lid portion (FIG. 6). The edge 54 of the lid portion 34 and short sections 56, 58 of the edges 50, 52 are rolled over and flattened as best shown in FIGS. 4 and 7 to permit the lid to be slid back-and-forth over the open front of the tray 32. As will be apparent, the lid 34 cannot be slid to the right (as viewed in FIGS. 4 and 10) to open the box since the rolled lip 46 along edge 48 of the lid acts as a positive stop or abutment when the lid 34 is moved in a direction to close the box 12.

Preferably, there is metal-to-metal engagement between the rolled lips 44, 46 along the edges 48, 50, 52 of the lid and between the rolled lip 44 of the tray 32 and the flattened edges 54, 56, 58 of the lid 34. Such metal-to-metal engagement between the lid and tray portions 32, 34 helps to preserve the freshness and aroma of the cigarettes C contained in the metal cigarette box 12. To the extent the rolled lips and flattened edges of the lid 34 do not engage completely in metal-to-metal sealing contact with the rolled lip 44 of the tray 32, the shrinkable band 38 provides an additional force that urges those lips and edges into sealing, metal-to-metal contact until the band 38 is removed from the box 12.

The metal from which the cigarette box 12 is formed is preferably a metal or metal alloy, such as 1018 steel alloy, having a thickness in the range of 0.005 inch to 0.015 inch. Other metals or metal alloys, such as 3003 aluminum alloy, may also be used to manufacture the box 12. Conventional metal working processes apparent to those skilled in the metal working art may be used to form the curved tray and lid and to roll and flatten the edges of the tray and lid. The tray preferably contains twenty cigarettes in a 2 by 10 arrangement.

While the box 12 of the present invention is preferably made of a thin sheet metal, it would be possible to mold the box of a polymeric material, e.g., an injection molded high density polyethylene, polycarbonate, or other suitable moldable plastic material. In such case, the interengaging lips between the tray and lid portions may be molded to sealingly engage in a manner similar to the engagement of rolled lips and edges of the metal tray and lid.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

It is therefore intended that the foregoing detailed description be regarded as illustrative rather than limiting, and that it be understood that it is the following claims, including all equivalents, that are intended to define the spirit and scope of this invention.

The invention claimed is:

1. A combination package for packaging articles such as cigarettes, the package comprising:

an inner metal package portion including a body having a convexly curving back and four side walls approximately perpendicularly upstanding from the back, an open front, a closed bottom and an upper edge of each of the four side walls being rolled over to form a smooth rolled lip around the periphery of the open front of the body;

a lid having a front surface and a back surface, a concavely curving front and three side walls, the side walls extending approximately perpendicularly downwardly from three edges of the lid, the side walls of the lid having a rolled lip that extends inward of, and engages, the rolled lip of the body side walls when the lid is in the closed position mounted on the body, such that a rolled portion of the front surface of the lid comprises a region of contact with a portion of the smooth rolled lip around the periphery of the open front of the body;

the lid including an abutment protruding downwardly from the back surface of the lid to a depth such that when the lid slides to an open position, the abutment hits a wall of the body to restrain further movement of the lid; and an outer paperboard package portion disposed about the inner metal package portion, and including a rectangular parallelepiped box;

a polymeric overwrap film overwrapping the box;

five sides of the box forming substantial complete rectangular faces and a sixth side of the box including a hingedly connected panel, the panel being attached along a fold line and covering only a portion of either the front lid surface of the metal package portion or the closed bottom of the metal package portion.

2. The package of claim 1, wherein the articles are cigarettes.

3. The package of claim 1, wherein the inner metal package portion includes a fourth edge of the lid and contiguous portions of edges adjoining the fourth edge of the lid have flattened edges.

4. The package of claim 1, wherein the inner metal package portion lid includes product differentiation indicia on the front surface.

5. The package of claim 1, wherein the inner metal package portion has disposed thereon a band shrink-wrapped around a joint formed between the body and the lid when in a closed position, the band having perforations therein for tearing the band and removing it from the metal package.

6. The package of claim 1, wherein the polymeric overwrap film of the outer paperboard package portion is transparent polymeric film, and product indicia are visibly applied on said outer paperboard package portion.

7. The package of claim 1, wherein the inner metal package portion is a steel or aluminum alloy having a thickness between about 0.005 inch and 0.015 inch.

8. The package of claim 1, wherein the front surface of the inner metal package portion lid includes product differentiation indicia and the abutment is located in an area of the lid covered by the indicia.

9. The package of claim 1, wherein the convexly curving back and the concavely curving back surface of the lid of the inner metal package portion each have a radius of curvature about 100 to about 800 millimeters.

10. The package of claim 1, wherein the back of the body and the lid of the inner metal package portion each have a radius of curvature of about 200 millimeters.

11. The package of claim 10, wherein the back of the body and the lid have co-centric curved surfaces.

12. The package of claim 1, further comprising a shrink-wrapped band around the rolled lips of the body and the lid of the inner metal package portion to retain the lid in a closed, tamperproof relation over the front of the body portion.

13. The package of claim 12, wherein the shrink-wrapped band includes perforations therein for tearing the band and removing it from the inner metal package portion.

14. The package of claim 1, wherein the outer paperboard package portion includes a tear tape connected with the polymeric overwrap film for removing the overwrap film from the paperboard package portion.

15. The package of claim 1, wherein the abutment of the inner metal package portion lid is a depression formed in the front surface of the lid that protrudes on the back surface of the lid.

16. The package of claim 1, wherein the abutment of the inner metal package portion lid depends from a central area of the back surface of the lid such that the abutment contacts the body to restrain further sliding of the lid portion in an opening direction when the lid is opened to a predetermined position.

17. The package of claim 16, wherein the predetermined position is less than half open.

18. The package of claim 16, wherein the predetermined position is at least about two cigarette widths.

19. The package of claim 16, wherein the predetermined position is between about one-fourth and one-half open.

20. The package of claim 1, wherein the inner metal package portion lid is sufficiently flexible to allow the abutment to slide over a wall of the body upon forcefully urging the lid in an opening direction.

21. The package of claim 1, wherein the inner metal package portion lid side walls are configured with a length such that the lid cannot be slidingly urged in a closing direction beyond a closed position.

22. The package of claim 1, wherein the inner metal package portion body is sized to contain 20 cigarettes arranged in two layers.

23. The package of claim 1, wherein a printed indicia is placed over a central portion of the front surface of the inner metal package portion lid and the abutment is formed from a depression in the front surface of the inner metal package portion lid beneath where the printed indicia is located.

24. The package of claim 1, wherein of the convex body and concave lid of the inner metal package portion each have a radius of curvature selected such that the major lid and body surfaces are co-centric about a common axis when the rolled lips of the respective lid and body portions are engaged.

* * * * *